US010434565B2

(12) United States Patent
Ikada et al.

(10) Patent No.: US 10,434,565 B2
(45) Date of Patent: Oct. 8, 2019

(54) SWAGING TOOL

(71) Applicant: MITSUBISHI HEAVY INDUSTRIES, LTD., Tokyo (JP)

(72) Inventors: Akira Ikada, Tokyo (JP); Taro Takeuchi, Tokyo (JP); Yuki Utsumi, Tokyo (JP); Iori Kishimoto, Aichi (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 694 days.

(21) Appl. No.: 15/101,414

(22) PCT Filed: Nov. 13, 2014

(86) PCT No.: PCT/JP2014/080089

§ 371 (c)(1),
(2) Date: Jun. 3, 2016

(87) PCT Pub. No.: WO2015/083520

PCT Pub. Date: Jun. 11, 2015

(65) Prior Publication Data

US 2016/0303641 A1 Oct. 20, 2016

(30) Foreign Application Priority Data

Dec. 6, 2013 (JP) ..... 2013-253680

(51) Int. Cl.
*B21J 15/00* (2006.01)
*B21J 15/26* (2006.01)
(Continued)

(52) U.S. Cl.
CPC ..... *B21J 15/26* (2013.01); *B21J 15/022* (2013.01); *B21J 15/043* (2013.01); *B21J 15/046* (2013.01);
(Continued)

(58) Field of Classification Search
CPC ..... B21J 15/26; B21J 15/022; B21J 15/043; B21J 15/046; B21J 15/105; B21J 15/20; B21J 15/32; B25B 27/0014; B25B 9/12
(Continued)

(56) References Cited

U.S. PATENT DOCUMENTS 4,574,612 A * 3/1986 Tanikawa ..... B25B 27/0014 72/114
4,813,261 A 3/1989 Rosier
(Continued)

FOREIGN PATENT DOCUMENTS

CN 1175916 A 3/1998
CN 101378861 A 3/2009
(Continued)

OTHER PUBLICATIONS

Office Action in CN Application No. 201480066221.7, dated Dec. 22, 2016.
(Continued)

*Primary Examiner* — David B Jones
(74) *Attorney, Agent, or Firm* — Hauptman Ham, LLP

(57) ABSTRACT

A swaging tool for fastening a pair of plate members sewages a collar fitted to a pintail side of a fastening pin, where a pinhead of the fastening pin is positioned on one of the plate members and the pintail of the fastening pin is positioned on the other plate member, to the fastening pin with the collar being in contact with the other plate member and to apply a tensile load to the pintail to break off and remove the pintail. The swaging tool includes a holding member that holds the pintail of the fastening pin, a swaging member having a swaging die that comes into contact with and sewages the collar, and a stroke mechanism configured to expand and contract a space between the swaging member and the holding member. The stroke mechanism includes a
(Continued)

rotatable rotary member that converts a rotation of the rotary member to the expansion and contraction of the space between the holding member and the swaging member and restricts a rotation of the swaging member and a rotation of the holding member.

4 Claims, 6 Drawing Sheets

(51) Int. Cl.

| | |
|---|---|
| ***B21J 15/04*** | (2006.01) |
| ***B21J 15/32*** | (2006.01) |
| ***B21J 15/20*** | (2006.01) |
| ***B21J 15/10*** | (2006.01) |
| ***B21J 15/02*** | (2006.01) |

(52) U.S. Cl.
CPC ..... *B21J 15/105* (2013.01); *B21J 15/20* (2013.01); *B21J 15/32* (2013.01)

(58) Field of Classification Search
USPC ..... 29/243.526
See application file for complete search history.

(56) References Cited

U.S. PATENT DOCUMENTS

| | | | | |
|---|---|---|---|---|
| 4,956,991 | A * | 9/1990 | Noonan | B23P 9/025 29/446 |
| 5,131,255 | A | 7/1992 | Fushiya et al. | |
| 5,548,889 | A | 8/1996 | Smith et al. | |
| 7,155,953 | B1 * | 1/2007 | Nikkel | B21J 15/046 29/243.526 |
| 8,161,622 | B2 * | 4/2012 | King | B21J 15/043 29/243.521 |
| 8,561,275 | B2 * | 10/2013 | Wille | B25B 27/0014 29/243.523 |
| 9,724,751 | B2 * | 8/2017 | Stahl | B21J 15/043 |
| 9,833,832 | B2 * | 12/2017 | Weyland | B21J 15/043 |
| 2009/0101689 | A1 | 4/2009 | Wille | |

FOREIGN PATENT DOCUMENTS

| | | | |
|---|---|---|---|
| EP | 0000626 | A1 | 2/1979 |
| JP | 50-6392 | B1 | 3/1975 |
| JP | 54-23300 | A | 2/1979 |
| JP | 3-503984 | A | 9/1991 |
| JP | 4-75882 | A | 3/1992 |
| JP | 11-505474 | A | 5/1999 |
| JP | 2009-525876 | A | 7/2009 |

OTHER PUBLICATIONS

Office Action in JP Application No. 2015-551445, dated Feb. 28, 2017.
International Search Report dated Feb. 3, 2015, in International Application No. PCT/JP2014/080089.
Written Opinion in PCT Application No. PCT/JP2014/080089, dated Feb. 3, 2015.
Extended European Search Report in EP Application No. 14867902.0, dated Oct. 14, 2016.
Notice of Acceptance in AU Application No. 2014358389, dated Nov. 21, 2016.

* cited by examiner

SWAGING TOOL

RELATED APPLICATIONS

The present application is a National Phase entry of International Application No. PCT/JP2014/080089, filed Nov. 13, 2014, which claims priority of Japanese Application No. 2013-253680, filed Dec. 6, 2013.

TECHNICAL FIELD

The present invention relates to a swaging tool for fastening a portion to be fastened by swaging a collar to a fastening pin.

BACKGROUND ART

A hydraulic swaging tool configured to swage a collar to a fastening pin by operating a piston inside a cylinder using a fluid has been disclosed (see Patent Document 1, for example). Note that examples of such a swaging tool besides a hydraulic swaging tool include a swaging tool in which a piston inside a cylinder is operated by air pressure.

CITATION LIST

Patent Literature

Patent Document 1: U.S. Pat. No. 5,548,889

SUMMARY OF INVENTION

Technical Problem

However, because the swaging tool disclosed in Patent Document 1 is a hydraulic swaging tool, it is necessary to provide therein a port for causing the fluid to flow into the cylinder, a port for causing the fluid to flow out of the cylinder, an oil passage for circulating the fluid, and the like. Further, because it is necessary to secure the stroke of the piston with respect to the cylinder, a configuration of the swaging tool becomes complex, and consequently, the size of the swaging tool becomes large. When the size of the swaging tool becomes large, it becomes difficult to use the tool where a work space is limited, and as a result, the tool becomes less versatile.

In light of the foregoing, an object of the present invention is to provide a compact swaging tool that can be easily used even when a work space is limited.

Solution to Problem

A swaging tool for fastening a portion to be fastened according to the present invention is configured to move a collar fitted to a pintail side of a fastening pin toward a pinhead side so as to bring the collar into contact with the portion to be fastened, the pinhead of the fastening pin being positioned on one side of the portion to be fastened through which the fastening pin is inserted and the pintail of the fastening pin being positioned on the other side of the portion to be fastened, to swage the collar to the fastening pin with the collar being in contact with the portion to be fastened, and to apply a tensile load to the pintail to break off and remove the pintail. The swaging tool includes a holding member configured to hold the pintail of the fastening pin; a swaging member having a swaging die formed therein, the swaging die being configured to come into contact with and swage the collar; and a stroke mechanism configured to expand and contract a space between the swaging member and the holding member. The stroke mechanism includes a rotatable rotary member and is configured to convert a rotation of the rotary member to an expansion and contraction of the space between the holding member and the swaging member and to restrict a rotation of the swaging member and a rotation of the holding member.

According to this configuration, the rotation of the rotary member of the stroke mechanism can be converted to the expansion and contraction of the swaging member, thereby allowing the space between the holding member and the swaging member to expand and contract. It is thus possible to apply a sufficient tensile load to the pintail, which can cause the pintail to break off. At this time, because the stroke mechanism restricts the rotation of the swaging member and the holding member resulting from the rotation of the rotary member, the swaging member does not rotate with respect to the collar, and the holding member does not rotate with respect to the pintail of the fastening pin, either. As a result, the pintail is not twisted by the rotation of the rotary member, and it is thus possible to inhibit the pintail from breaking off due to the twist and to inhibit the pintail from breaking off before reaching a predetermined tensile load. This makes it possible to cause the pintail to break off at the predetermined tensile load. As described above, the rotation of the rotary member makes it possible to break off the pintail by swaging the collar to the fastening pin, because a tensile force is applied to the pintail by swaging the collar to the fastening pin. Therefore, there is no need to install a hydraulic mechanism or the like, allowing the configuration of the swaging tool to be simple and accordingly the swaging tool to be more compact. Accordingly, a compact swaging tool that can be easily used even when the work space is limited can be provided.

Further, it is preferable that the stroke mechanism be provided between the holding member and the swaging member, the stroke mechanism including a housing member configured to house the holding member therein, the rotary member provided between the housing member and the swaging member and configured to be screwed with the swaging member, and a low friction mechanism provided between the rotary member and the housing member and capable of absorbing the rotation of the rotary member, and that the rotation of the rotary member causes the swaging member to perform the expansion and contraction.

According to this configuration, the rotation of the rotary member makes it possible to cause the swaging member screwed with the rotary member to perform the expansion and contraction without causing the swaging member to rotate. At this time, by providing a low friction mechanism between the rotary member and the housing member, it is possible to absorb the rotation of the rotary member using the low friction mechanism, which makes it possible to restrict the rotation of the holding member housed in the housing member. Note that examples of such a low friction mechanism include a bearing, a washer to which a low friction coating is applied, and a high-lubrication sheet, but the low friction mechanism is not particularly limited to those examples.

Further, it is preferable that the stroke mechanism be provided between the holding member and the swaging member, the stroke mechanism including a housing member configured to house the holding member therein, the rotary member configured to be screwed with the housing member, and a movable member provided between the rotary member and the swaging member, the movable member being configured to come into contact with the rotary member and to be connected to the swaging member, and to perform the expansion and contraction together with the rotary member through the rotation of the rotary member, and that the movable member be locked with respect to the housing member so as to be able to perform the expansion and contraction while the rotation of the movable member is restricted with respect to the housing member.

According to this configuration, the rotation of the rotary member causes the movable member, which is in contact with the rotary member, to perform the expansion and contraction, which allows the space between the holding member and the swaging member to expand and contract. At this time, because the rotation of the movable member with respect to the housing member is restricted, it is possible to restrict the rotation of the holding member, which is housed in the housing member, and the rotation of the swaging member, which is connected to the movable member.

Further, it is preferable that the movable member include a locking claw configured to restrict the rotation of the movable member with respect to the housing member and to allow the movable member to perform the expansion and contraction with respect to the housing member, and that a locking groove configured to house the locking claw be formed in the housing member.

According to this configuration, by using the locking claw provided on the movable member and the locking groove formed in the housing member, the rotation of the movable member with respect to the housing member is restricted, while it is possible to cause the movable member to perform the expansion and contraction with respect to the housing member.

Further, it is preferable that the stroke mechanism include a housing member configured to house the holding member therein, a fixing member configured to be fixed to the housing member, and the rotary member configured to be screwed with the fixing member as well as with the swaging member, that the rotary member and the swaging member be screwed with each other by one of a right-hand thread and a left-hand thread, and that the rotary member and the fixing member be screwed with each other by the other one of the right-hand thread and the left-hand thread.

According to this configuration, the rotation of the rotary member makes it possible to cause the rotary member to perform the expansion and contraction without causing the fixing member screwed with the rotary member to rotate, and also makes it possible to cause the swaging member screwed with the rotary member to perform the expansion and contraction without causing the swaging member to rotate. At this time, because the rotary member and the swaging member are screwed with each other by the one of the right-hand thread and the left-hand thread, and the rotary member and the fixing member are screwed with each other by the other one of the right-hand thread and the left-hand thread, it is possible to offset the respective rotations, and it is thus possible to restrict the rotation of the holding member housed in the housing member and the swaging member.

Further, it is preferable that the stroke mechanism include a first extending portion extending outwardly from a housing member, the housing member being provided between the holding member and the swaging member and configured to house the holding member therein, a second extending portion extending from the swaging member so as to face the first extending portion with a predetermined gap, a guide member extending from the first extending portion to the second extending portion through the gap, and the rotary member configured to be screwed with the guide member positioned in the gap, and that the rotation of the rotary member with respect to the guide member expand and contract a space between the first extending portion and the second extending portion.

According to this configuration, rotating the rotary member to move the rotary member along the guide member makes it possible to expand and contract the space between the first extending portion and the second extending portion. At this time, because the rotary member rotates with respect to the guide member, the rotation of the rotary member is not transmitted to the housing member and the swaging member, and it is thus possible to restrict the rotation of the holding member housed in the housing member and the swaging member.

Further, it is preferable that the stroke mechanism include a first extending portion extending outwardly from an housing member, the housing member being provided between the holding member and the swaging member and configured to house the holding member therein, a second extending portion extending from the swaging member so as to face the first extending portion with a predetermined gap, a guide member extending from the first extending portion to the second extending portion through the gap, a drive shaft provided between the guide member and the holding member so as to extend from the first extending portion to the second extending portion through the gap, and the rotary member configured to be screwed with the drive shaft positioned in the gap, the rotation of the rotary member with respect to the drive shaft expanding and contracting a space between the first extending portion and the second extending portion.

According to this configuration, disposing the guide member and the drive shaft adjacent to each other makes it possible to provide a guiding part and a driving part so that the guiding part and the driving part are offset with respect to each other. As a result, even when the rigidity of the guide member is increased by making the guide member larger in order to apply a larger tensile load to the fastening pin, it is possible to suppress an increase in the dimension of the drive shaft in the axial direction. It is thus possible to fasten the fastening pin in a stable manner with a compact configuration.

Further, the stroke mechanism preferably further includes a protruding portion that protrudes toward the swaging die and is housed in the swaging die. The protruding portion preferably moves toward the swaging die so as to be pressed against the collar, when the space between the swaging member and the holding member is contracted by the rotation of the rotary member.

According to this configuration, in a state in which the space between the holding member and the swaging member is expanded and the collar is fitted into the swaging die of the swaging member, when the rotary member is rotated so that the space between the holding member and the swaging member is contracted, the protruding portion approaches the swaging die and comes into contact with the collar. Here, because the space between the holding member and the swaging member can be contracted in a state in which the protruding portion is in contact with the collar, it is possible to easily pull out the swaging member fitted with the collar.

DESCRIPTION OF EMBODIMENTS

Embodiments according to the present invention will be described below in detail on the basis of the drawings. Note that the present invention is not limited to those embodiments. In addition, the constituent elements in the embodiments described below include those that can be easily replaced by a person skilled in the art or those that are substantially the same.

First Embodiment

Figure 1:
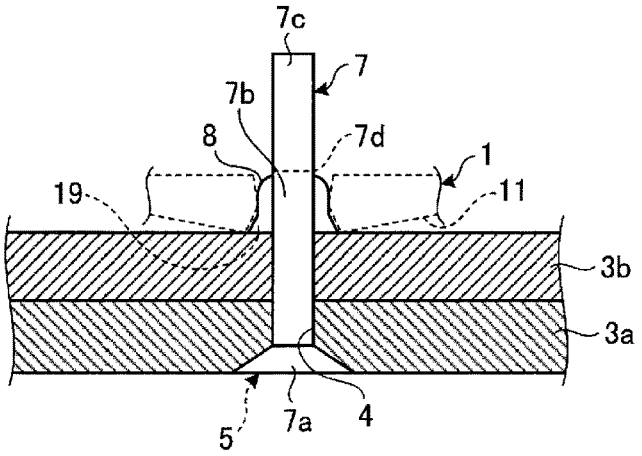
FIG. 1 is an outline configuration diagram schematically illustrating a lock bolt to be fastened by a swaging tool according to a first embodiment.
Figure 2:
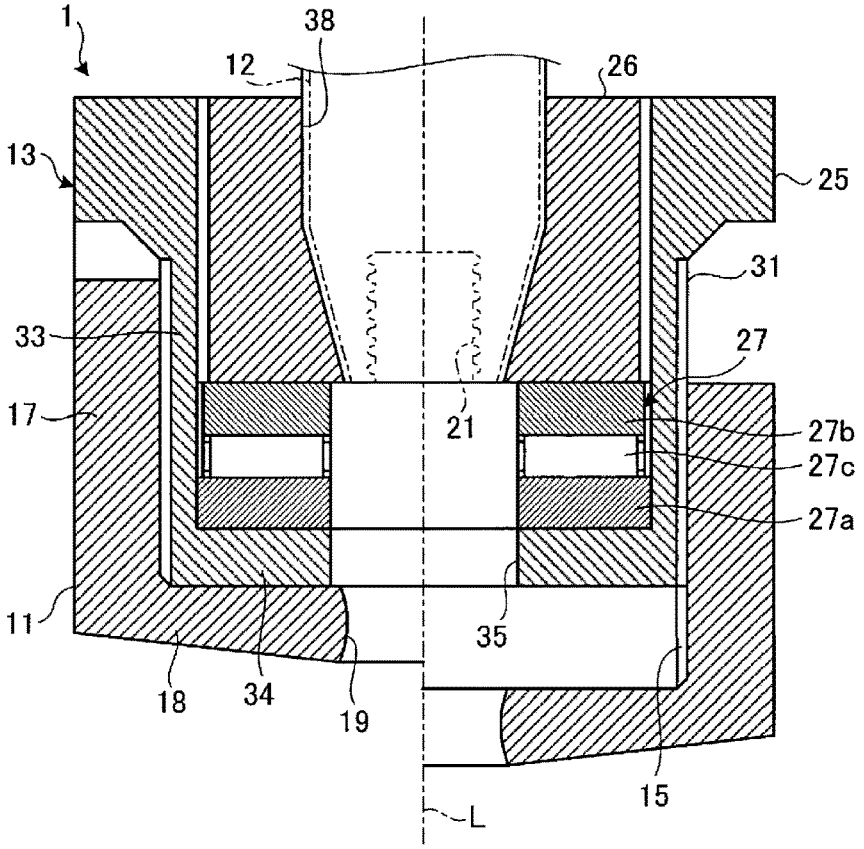
FIG. 2 is a cross-sectional view of the swaging tool according to the first embodiment.

FIG. 1 is an outline configuration diagram schematically illustrating a lock bolt to be fastened by a swaging tool according to a first embodiment. FIG. 2 is a cross-sectional view of the swaging tool according to the first embodiment.

A swaging tool 1 of the first embodiment is a tool for fastening a lock bolt 5 with respect to a pair of plate members 3*a* and 3*b* that are stacked together to form a portion to be fastened. First, with reference to FIG. 1, the lock bolt 5 will be described, which is fastened to the pair of plate members 3*a* and 3*b* by the swaging tool 1.

As illustrated in FIG. 1, the lock bolt 5 includes a fastening pin 7 extending in the axial direction and a collar 8 that is to be swaged to the fastening pin 7. The fastening pin 7 includes a pinhead 7*a* provided on one side in the axial direction, a pin main body 7*b* provided in a central section of the fastening pin 7, a pintail 7*c* provided on the other side in the axial direction. Further, a break-off portion 7*d* is provided between the pin main body 7*b* and the pintail 7*c*. The break-off portion 7*d* can break as a result of a predetermined tensile load being applied to each of the pin main body 7*b* and the pintail 7*c*.

This fastening pin 7 is inserted into a fastening hole 4, which is formed so as to penetrate through the pair of plate members 3*a* and 3*b* in the stacking direction thereof. When a fastening operation is performed on the fastening pin 7, which is inserted into the fastening hole 4, the pinhead 7*a* is positioned on the one plate member 3*a* side (the lower side in FIG. 1) and the pintail 7*c* is positioned on the other plate member 3*b* side (the upper side in FIG. 1), while sandwiching the pair of plate members 3*a* and 3*b* therebetween. Further, part of the pin main body 7*b* is positioned inside the fastening hole 4, and the remaining part is positioned on the other plate member 3*b* side (the upper side in FIG. 1).

The collar 8 is formed in a cylindrical shape and fitted from the pintail 7*c* side of the fastening pin 7. The collar 8 fitted to the fastening pin 7 comes into contact with the plate member 3*b* as a result of being moved in the axial direction toward the plate member 3*b* (the pinhead 7*a* side) by the swaging tool 1, and swaged to the pin main body 7*b* in a state of being in contact with the plate member 3*b*. After this, the break-off portion 7*d* breaks as a result of the predetermined tensile load being applied to the fastening pin 7, and the pintail 7*c* is broken off and removed.

Next, the swaging tool 1 will be described with reference to FIG. 2. Note that, in FIG. 2, part on the left side of an axial line L illustrates a contracted state of the swaging tool 1, and part on the right side of the axial line L illustrates an expanded state of the swaging tool 1. As illustrated in FIG. 2, the swaging tool 1 includes a swaging member 11, a holding member 12, and a stroke mechanism 13.

The swaging member 11 has a bottomed cylindrical shape. An inner thread groove 15 is formed on the inner circumferential surface of the swaging member 11. More specifically, the swaging member 11 includes a cylindrical portion 17, which has the inner thread groove 15 formed on the inner circumferential surface thereof, and a circular bottom portion 18 provided on the one side (the lower side in FIG. 2) of the cylindrical portion 17 in the axial direction. The cylindrical portion 17 and the bottom portion 18 are integrally formed. A swaging die 19 is formed in a central section of the bottom portion 18. The swaging die 19 swages the collar 8 as a result of the collar 8, which is fitted to the fastening pin 7, being press-fitted into the swaging die 19. Further, the inner bottom surface of the bottom portion 18 functions as a restricting surface that restricts the axial-direction movement of a rotary member 25 (described below), which is housed inside the cylindrical portion 17. Therefore, a state in which the swaging member 11 is in contact with the rotary member 25 on the restricting surface corresponds to a state in which the swaging tool 1 is most contracted.

The holding member 12 is a member that holds the pintail 7*c* of the fastening pin 7. For example, a chuck with a holding claw, or the like is applied as the holding member 12. A holding hole 21 for holding the pintail 7*c* is formed in the holding member 12 on the one side (the lower side in FIG. 2) in the axial direction. Further, the holding member 12 is formed in a tapered shape that tapers toward the one side in the axial direction.

The stroke mechanism 13 is provided between the swaging member 11 and the holding member 12. The rotation of the stroke mechanism 13 expands and contracts a space between the swaging member 11 and the holding member 12 in the axial direction. Further, the stroke mechanism 13 is configured so as to be able to restrict the rotation of the swaging member 11 and the holding member 12. More specifically, the stroke mechanism 13 includes the rotary member 25, a housing member 26, and a bearing (a low friction mechanism) 27.

The rotary member 25 is formed in a bottomed cylindrical shape, which is provided inside the swaging member 11. An outer thread groove 31, which engages with the inner thread groove 15 of the swaging member 11, is formed on the outer circumferential surface of the rotary member 25. More specifically, the rotary member 25 includes a cylindrical portion 33, which has the outer thread groove 31 formed on the outer circumferential surface thereof, and a circular bottom portion 34 provided on the one side (the lower side in FIG. 2) of the cylindrical portion 33 in the axial direction. The cylindrical portion 33 and the bottom portion 34 are integrally formed. An insertion hole 35 is formed in a central section of the bottom portion 34. The insertion hole 35 has a diameter a little larger than that of the swaging die 19, thereby enabling the fastening pin 7 and the swaged collar 8 to be inserted thereinto. Further, the outer bottom surface of the bottom portion 34 can be brought into contact with the inner bottom surface (the restricting surface) of the bottom portion 18 of the swaging member 11. The bearing 27 is installed on the inner bottom surface of the bottom portion 34.

Note that the rotary member 25 may be rotated by power transmitted from a power source (not illustrated), or may be rotated manually by using a jig, such as a wrench, a torque wrench, or the like.

The bearing 27, which is, for example, a thrust cylindrical roller bearing, is provided inside the rotary member 25. This bearing 27 includes a pair of races 27*a* and 27*b*, and a cylindrical roller 27*c*, which is provided between the pair of races 27*a* and 27*b* as a rolling element. The race (lower race) 27*a* on the one side is arranged on the inner bottom surface of the bottom portion 34 of the rotary member 25 and is rotated together with the rotation of the rotary member 25. Note that the lower race 27*a* may be fixed to the rotary member 25. The race (upper race) 27*b* on the other side is arranged so as to face the lower race 27*a* while sandwiching the cylindrical roller 27*c* therebetween. The upper race 27*b* is arranged with a predetermined gap with respect to the rotary member 25 provided on the outer side of the upper race 27*b* in the radial direction. The upper race 27*b* is in a non-contact state with respect to the rotary member 25. The housing member 26 is installed on the upper race 27*b*.

The housing member 26 houses the holding member 12 therein, and is installed on the upper race 27*b*. At this time, the housing member 26 may be fixed to the upper race 27*b*. Further, the housing member 26 is provided on the inner side of the rotary member 25, and an end surface of the housing member 26 on the other side (the upper side in FIG. 2) and an end surface of the rotary member 25 on the other side are configured to be flush with each other. The housing member 26 is arranged with a predetermined gap with respect to the rotary member 25 provided on the outer side of the housing member 26 in the radial direction. The housing member 26 is in a non-contact state with respect to the rotary member 25. The housing member 26 is formed in a cylindrical shape as a result of a housing hole 38, which houses the holding member 12, being formed so as to penetrate through a central section of the housing member 26. Because the housing hole 38 has a complementary shape with the holding member 12, the housing hole 38 has a tapered shape that tapers toward the one side in the axial direction. Because the holding member 12, which is housed in the housing hole 38 of the housing member 26, and the housing hole 38 each have the tapered shape, the movement of the holding member 12 toward the one side in the axial direction is restricted, even when a load is applied relatively to the one side.

Next, the fastening operation of the swaging tool 1 will be described in which the lock bolt 5 is fastened by using the above-described swaging tool 1. The fastening pin 7 is inserted into the fastening hole 4 of the pair of plate members 3*a* and 3*b*, and the collar 8 is fitted to the pintail 7*c* side of the fastening pin 7. At this time, the swaging tool 1 is in the most contracted state, as illustrated in the left-side part of FIG. 2. The swaging tool 1 being in this state is fitted to the pintail 7*c* of the fastening pin 7. More specifically, the pintail 7*c* side of the fastening pin 7 is inserted through the swaging die 19 of the swaging tool 1 and the insertion hole 35 of the rotary member 25, and further, the pintail 7*c* is held by the holding member 12, as a result of the pintail 7*c* being fitted into the holding hole 21 of the holding member 12 of the swaging tool 1.

Subsequently, in a state in which the pintail 7*c* is held in the swaging tool 1, the rotary member 25 is rotated. When the rotary member 25 is rotated, the swaging tool 1 performs an expansion that causes a distance between the swaging member 11 and the holding member 12 in the axial direction to increase. At this time, because the swaging tool 1 is holding the pintail 7*c* by the holding member 12, when the expansion is performed, the swaging member 11 moves toward the plate member 3*b*. More specifically, when the rotary member 25 is rotated, the swaging member 11 moves in the axial direction toward the plate member 3*b* with respect to the rotary member 25. At this time, because the rotating rotary member 25 is connected to the housing member 26 via the bearing 27, the rotation is absorbed by the bearing 27, and the transmission of the rotation to the housing member 26 is suppressed. When the swaging member 11 moves toward the plate member 3*b*, the swaging member 11 comes in contact with the collar 8 fitted to the pintail 7*c* side, thereby pushing the collar 8 toward the plate member 3*b*. Then, the collar 8, which is pushed toward the plate member 3*b*, comes into contact with the plate member 3*b*. As a result, the collar 8, which is in contact with the plate member 3*b*, is positioned at the pin main body 7*b* of the fastening pin 7.

After this, in the swaging tool 1, the rotary member 25 is further rotated in a state in which the collar 8 is in contact with the plate member 3*b*. When the rotary member 25 is rotated, as a result of the swaging tool 1 further performing the expansion, the collar 8 is press-fitted into the swaging die 19 of the swaging member 11. As a result of being press-fitted into the swaging die 19, the collar 8 is swaged to the pin main body 7*b* of the fastening pin 7.

Then, in the swaging tool 1, the rotary member 25 is further rotated in a state in which the collar 8 is swaged to the pin main body 7*b*. When the rotary member 25 is rotated, as a result of the swaging tool 1 further performing the expansion, each of the pin main body 7*b* and the pintail 7*c* is pulled in a direction of separating away from each other, and consequently, the predetermined tensile load is applied to the break-off portion 7*d* provided between the pin main body 7*b* and the pintail 7*c*. The swaging tool 1 causes the pintail 7*c* of the fastening pin 7 to break off by applying the predetermined tensile load to the break-off portion 7*d*. When the pintail 7*c* breaks off, the swaging tool 1 is disconnected from the fastened lock bolt 5 in a state in which the broken-off pintail 7*c* is held by the holding member 12.

Note that the swaging tool 1, which has been disconnected from the lock bolt 5, performs a contraction, which causes the distance between the swaging member 11 and the holding member 12 in the axial direction to decrease, by rotating the rotary member 25 in the opposite direction. By performing the contraction, the swaging tool 1 obtains the most contracted state. At this time, the inner bottom surface of the swaging member 11 and the outer bottom surface of the rotary member 25 come into contact with each other. Then, by removing the broken-off pintail 7*c* held by the holding member 12, the swaging tool 1 returns to the state illustrated in the left-side part of FIG. 2.

As described above, according to the configuration of the first embodiment, the rotation of the rotary member 25 of the stroke mechanism 13 makes it possible to expand and contract the space between the swaging member 11 and the holding member 12. Accordingly, because the rotation of the rotary member 25 can be converted to the expansion and contraction, it is possible to apply the tensile load to the pintail 7*c*, which can cause the pintail 7*c* to break off. At this time, because the stroke mechanism 13 restricts the rotation of the swaging member 11 and the holding member 12 resulting from the rotation of the rotary member 25, the swaging member 11 does not rotate with respect to the collar 8, and the holding member 12 does not rotate with respect to the pintail 7*c* of the fastening pin 7, either. As a result, the pintail 7*c* is not twisted by the rotation of the rotary member 25, and it is possible to inhibit the pintail 7*c* from breaking off due to the twist. Further, because it is possible to inhibit the pintail 7*c* from breaking off before reaching the predetermined tensile load, it is possible to cause the pintail 7*c* to break off at the predetermined tensile load. As described above, because it is possible to cause the pintail 7*c* to break off by swaging the collar 8 to the fastening pin 7 as a result of rotating the rotary member 25, there is no need to install a hydraulic mechanism or the like in the swaging tool 1. It is thus possible to make the configuration of the swaging tool 1 simple, and accordingly, make the swaging tool 1 more compact. As a result, it is possible to provide the compact swaging tool 1 that can be used even when the work space is limited.

Further, according to the configuration of the first embodiment, the rotation of the rotary member 25 makes it possible to expand and contract the space between the swaging member 11 and the holding member 12, without causing the swaging member 11, which is screwed with the rotary member 25, to rotate. Further, by providing the bearing 27 between the rotary member 25 and the housing member 26, it is possible to absorb the rotation of the rotary member 25 by the bearing 27. As a result, it is possible to restrict the rotation of the holding member 12, which is housed in the housing member 26.

Note that, although in the first embodiment a thrust bearing, which receives the load in the axial direction (the thrust direction) is used as the bearing 27, the present invention is not limited to this configuration, and an angular bearing, which receives the load in the thrust and radial directions, may be adopted. In this case, the angular bearing may be provided in any position, as long as the angular bearing is provided in a position between the rotary member 25 and the housing member 26. Further, the configuration of the first embodiment is not limited to a bearing, but any low friction mechanism may be used, such as a washer to which a low-friction coating has been applied, or a high-lubrication sheet. Furthermore, by providing a groove or the like in the tool main body, for example, only bearing balls may be directly placed therein.

Second Embodiment

Figure 3:
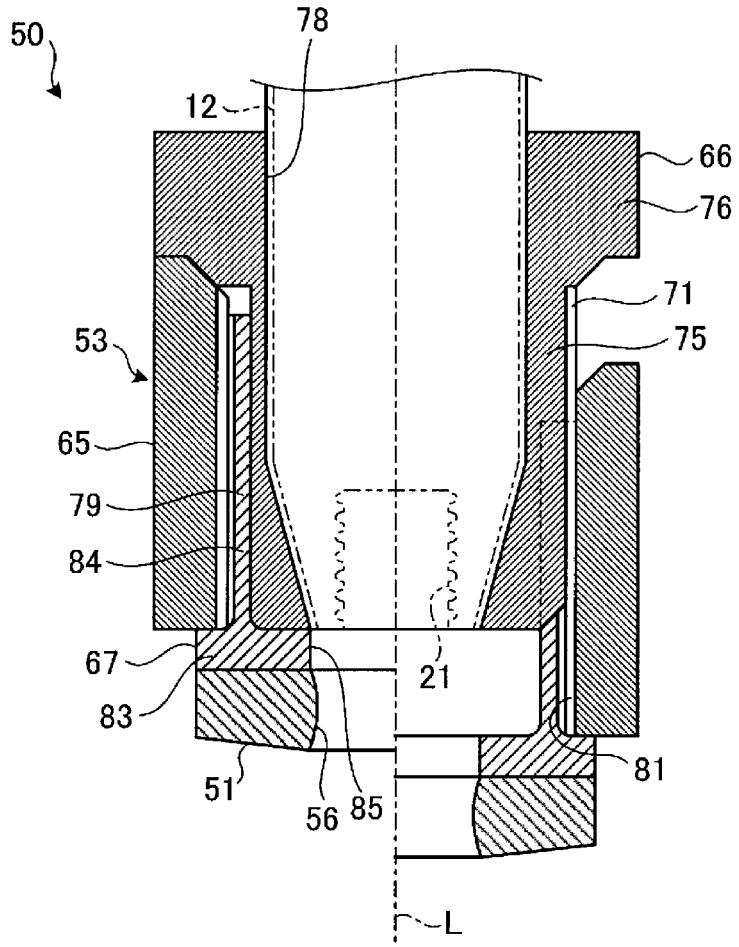
FIG. 3 is a cross-sectional view of a swaging tool according to a second embodiment.

Next, a swaging tool 50 according to a second embodiment will be described with reference to FIG. 3. FIG. 3 is a cross-sectional view of the swaging tool according to the second embodiment. Note that in the second embodiment, in order to avoid redundant descriptions, descriptions will be given only for structural elements different from those of the first embodiment, and the same reference numerals will be assigned to structural elements having the same configuration as that of the first embodiment. The swaging tool 1 according to the first embodiment restricts the rotation of the swaging member 11 and the holding member 12 by absorbing the rotation of the rotary member 25 by using the bearing 27. In contrast, the swaging tool 50 according to the second embodiment restricts the rotation of a swaging member 51 and the holding member 12 by using a locking claw 84. The swaging tool 50 according to the second embodiment will be described below. Note that in FIG. 3, in the same manner as in FIG. 2, part on the left side of the axial line L illustrates a contracted state of the swaging tool 50, and part on the right side of the axial line L illustrates an expanded state of the swaging tool 50.

As illustrated in FIG. 3, the swaging tool 50 according to the second embodiment includes the swaging member 51, the holding member 12, and a stroke mechanism 53. Note that because the holding member 12 has the same configuration as in the first embodiment, a description thereof is omitted here.

The swaging member 51 is formed in a disc-shape, and a swaging die 56 is formed in a central section of the swaging member 51. The swaging die 56 sewages the collar 8 as a result of the collar 8, which is fitted to the fastening pin 7, being press-fitted into the swaging die 56. A movable member 67, which will be described below, is connected to the other side of the swaging member 51 (the upper side in FIG. 3).

The stroke mechanism 53 is provided between the swaging member 51 and the holding member 12. The rotation of the stroke mechanism 53 expands and contracts a space between the swaging member 51 and the holding member 12 in the axial direction. Further, the stroke mechanism 53 is configured so as to be able to restrict the rotation of the swaging member 51 and the holding member 12. More specifically, the stroke mechanism 53 includes a rotary member 65, a housing member 66, and the movable member 67.

The housing member 66 houses the holding member 12 therein, and an outer thread groove 71 is formed on the outer circumferential surface of the housing member 66. More specifically, the housing member 66 includes a cylindrical portion 75, which has the outer thread groove 71 formed on the outer circumferential surface thereof, and a ring-shaped flange portion 76 provided on the other side (the upper side in FIG. 3) of the cylindrical portion 75 in the axial direction. The cylindrical portion 75 and the flange portion 76 are integrally formed.

The cylindrical portion 75 is formed in a cylindrical shape, as a result of a housing hole 78, which houses the holding member 12, being formed so as to penetrate through a central section of the cylindrical portion 75. Because the housing hole 78 has a complementary shape with the holding member 12, the housing hole 78 has a tapered shape that tapers toward the one side in the axial direction. Because the holding member 12, which is housed in the housing hole 78 of the housing member 66, and the housing hole 78 each have the tapered shape, the movement of the holding member 12 toward the one side (the lower side in FIG. 3) in the axial direction is restricted, even when a load is applied relatively to the one side. Further, a locking groove 79 is formed in the cylindrical portion 75. The locking groove 79 houses the locking claw 84 of the movable member 67 (described below). The locking groove 79 is formed so as to extend in the axial direction with respect to the outer circumferential surface of the cylindrical portion 75. A plurality of the locking grooves 79 are formed side by side at predetermined intervals in the circumferential direction of the cylindrical portion 75.

The flange portion 76 is provided so as to protrude toward the outer side in the radial direction with respect to the cylindrical portion 75, while being formed in a ring-shape. A surface of the flange portion 76 on the one side (the lower side in FIG. 3) in the axial direction functions as a restricting surface that restricts the movement of the rotary member 65 in the axial direction. Therefore, a state in which the housing member 66 is in contact with the rotary member 65 on the restricting surface corresponds to a state in which the swaging tool 50 is most contracted.

The rotary member 65 is provided on the outer side of the housing member 66, while being formed in a cylindrical shape. An inner thread groove 81, which engages with the outer thread groove 71 of the housing member 66, is formed on the inner circumferential surface of the rotary member 65. An end surface of the rotary member 65 on the other side (the upper side in FIG. 3) in the axial direction is formed as a surface that comes into contact with the restricting surface of the flange portion 76. Further, an end surface of the rotary member 65 on the one side (the lower side in FIG. 3) is formed as a surface that comes into contact with a contact portion of the movable member 67 (described below).

The movable member 67 is provided between the swaging member 51 and the rotary member 65. The movable member 67 includes the contact portion 83, with which the rotary member 65 comes into contact, and the locking claw 84 that extends from the contact portion 83 toward the other side in the axial direction. The contact portion 83 and the locking claw 84 are integrally formed.

The contact portion 83 is formed in a ring-shape, and an insertion hole 85 is formed in a central section thereof. The insertion hole 85 has a diameter a little larger than that of the swaging die 56, thereby enabling the fastening pin 7 and the swaged collar 8 to be inserted thereinto. Further, the end surface of the rotary member 65 on the one side comes into contact with an outer circumferential edge portion of a surface of the contact portion 83 on the other side in the axial direction. Because the contact portion 83 is connected to the swaging member 51, the swaging member 51 can move together with the movable member 67.

The locking claw 84 is housed in the locking groove 79 formed on the outer circumferential surface of the housing member 66. The locking claw 84 restricts the rotation of the movable member 67 with respect to the housing member 66, and at the same time, allows the movement of the movable member 67 in the axial direction with respect to the housing member 66. This locking claw 84 is connected to the surface of the contact portion 83 on the other side, and a plurality of the locking claws 84 are formed side by side at predetermined intervals in the circumferential direction of the contact portion 83. Note that an engaging groove, which engages with the inner thread groove 81 of the rotary member 65, may be formed on the outer circumferential surface of the locking claw 84, namely, on the inner circumferential surface of the rotary member 65. However, this engaging groove need not necessarily be formed.

Next, a fastening operation of the swaging tool 50 will be described in which the lock bolt 5 is fastened by using the above-described swaging tool 50. The fastening pin 7 is inserted into the fastening hole 4 of the pair of plate members 3*a* and 3*b*, and the collar 8 is fitted to the pintail 7*c* side of the fastening pin 7. At this time, the swaging tool 50 is in the most contracted state, as illustrated in the lest-side part of FIG. 3. The swaging tool 50 in this state is fitted to the pintail 7*c* of the fastening pin 7. More specifically, the pintail 7*c* side of the fastening pin 7 is inserted through the swaging die 56 of the swaging tool 50 and the insertion hole 85 of the movable member 67, and the pintail 7*c* is held by the holding member 12 as a result of the pintail 7*c* being fitted into the holding hole 21 of the holding member 12 of the swaging tool 50.

Subsequently, in a state in which the pintail 7*c* is held in the swaging tool 50, the rotary member 65 is rotated. When the rotary member 65 is rotated, the swaging tool 50 performs an expansion that causes a distance between the swaging member 51 and the holding member 12 in the axial direction to increase. At this time, because the swaging tool 50 is holding the pintail 7*c* by the holding member 12, when the expansion is performed, the swaging member 51 moves toward the plate member 3*b*. More specifically, when the rotary member 65 is rotated, the rotary member 65 moves in the axial direction toward the plate member 3*b* with respect to the housing member 66. At this time, because the rotating rotary member 65 comes into contact with the movable member 67, the movable member 67 moves in the axial direction together with the rotary member 65. At this time, because the rotation of the movable member 67 with respect to the housing member 66 is restricted by the locking claws 84, the movable member 67 does not rotate, even when the rotating rotary member 65 comes into contact with the movable member 67. Then, because the movable member 67, which moves in the axial direction, is connected to the swaging member 51, the movable member 67 moves in the axial direction together with the swaging member 51. When the swaging member 51 moves toward the plate member 3*b*, the swaging member 51 comes into contact with the collar 8 fitted to the pintail 7*c* side, thereby pushing the collar 8 toward the plate member 3*b*. Then, the collar 8, which is pushed toward the plate member 3*b*, comes into contact with the plate member 3*b*. As a result, the collar 8, which is in contact with the plate member 3*b*, is positioned at the pin main body 7*b* of the fastening pin 7.

After this, in the swaging tool 50, the rotary member 65 is further rotated in a state in which the collar 8 is in contact with the plate member 3*b*. When the rotary member 65 is rotated, as a result of the swaging tool 50 further performing the expansion, the collar 8 is press-fitted into the swaging die 56 of the swaging member 51. As a result of being press-fitted into the swaging die 56, the collar 8 is swaged to the pin main body 7*b* of the fastening pin 7.

Then, in the swaging tool 50, the rotary member 65 is further rotated in a state in which the collar 8 is swaged to the pin main body 7*b*. When the rotary member 65 is rotated, as a result of the swaging tool 50 further performing the expansion, each of the pin main body 7*b* and the pintail 7*c* is pulled in the direction of separating away from each other, and consequently, the predetermined tensile load is applied to the break-off portion 7*d* provided between the pin main body 7*b* and the pintail 7*c*. The swaging tool 50 causes the pintail 7*c* of the fastening pin 7 to break off by applying the predetermined tensile load to the break-off portion 7*d*. When the pintail 7*c* breaks off, the swaging tool 50 is disconnected from the fastened lock bolt 5, in a state in which the broken-off pintail 7*c* is held by the holding member 12.

Note that the swaging tool 50, which has been disconnected from the lock bolt 5, performs a contraction, which causes the distance between the swaging member 51 and the holding member 12 in the axial direction to decrease, by rotating the rotary member 65 in the opposite direction. By performing the contraction, the swaging tool 50 obtains the most contracted state, as a result of the flange portion 76 of the housing member 66 and the surface of the rotary member 65 on the other side coming into contact with each other. Then, by removing the broken-off pintail 7*c* held by the holding member 12, the swaging tool 50 returns to the state illustrated in the left-side part of FIG. 3.

As described above, according to the configuration of the second embodiment, the rotation of the rotary member 65 makes it possible to cause the movable member 67 to come into contact with the rotary member 65 and to expand and contract the space between the swaging member 51 and the holding member 12. At this time, because the rotation of the movable member 67 with respect to the housing member 66 can be restricted by the locking claws 84 provided on the movable member 67, it is possible to restrict the rotation of the holding member 12 housed in the housing member 66 and the rotation of the swaging member 51 connected to the movable member 67.

Third Embodiment

Figure 4:
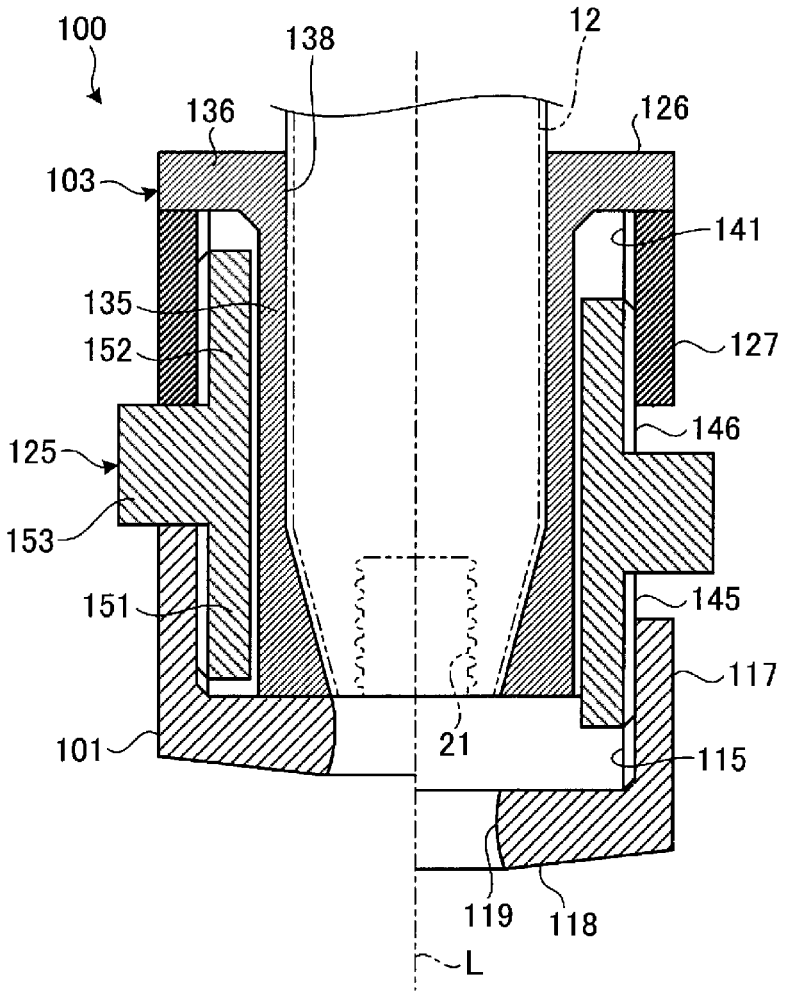
FIG. 4 is a cross-sectional view of a swaging tool according to a third embodiment.

Next, a swaging tool 100 according to a third embodiment will be described with reference to FIG. 4. FIG. 4 is a cross-sectional view of the swaging tool according to the third embodiment. Note that in the third embodiment also, in order to avoid redundant descriptions, descriptions will be given only for structural elements different from those of the first and second embodiments, and the same reference numerals will be assigned to structural elements having the same configuration as those of the first and second embodiments. The swaging tool 100 according to the third embodiment restricts the rotation of a swaging member 101 and the holding member 12 by absorbing the rotation of a rotary member 125 by using right and left threads. The swaging tool 100 according to the third embodiment will be described below. Note that in FIG. 4, in the same manner as in FIG. 2, part on the left side of the axial line L illustrates a contracted state of the swaging tool 100, and part on the right side of the axial line L illustrates an expanded state of the swaging tool 100.

As illustrated in FIG. 4, the swaging tool 100 according to the third embodiment includes the swaging member 101, the holding member 12, and a stroke mechanism 103. Note that, because the holding member 12 has the same configuration as in the first embodiment, a description thereof is omitted here.

The swaging member 101 has a bottomed cylindrical shape, and an inner right-hand thread groove 115 is formed on the inner circumferential surface of the swaging member 101. More specifically, the swaging member 101 includes a cylindrical portion 117, which has the inner right-hand thread groove 115 formed on the inner circumferential surface thereof, and a circular bottom portion 118 provided on the one side (the lower side in FIG. 4) of the cylindrical portion 117 in the axial direction. The cylindrical portion 117 and the bottom portion 118 are integrally formed. A swaging die 119 is formed in a central section of the bottom portion 118. The swaging die 119 sewages the collar 8 as a result of the collar 8, which is fitted to the fastening pin 7, being press-fitted into the swaging die 119.

The stroke mechanism 103 is provided between the swaging member 101 and the holding member 12. The rotation of the stroke mechanism 103 expands and contracts a space between the swaging member 101 and the holding member 12 in the axial direction. Further, the stroke mechanism 13 is configured so as to be able to restrict the rotation of the swaging member 101 and the holding member 12. More specifically, the stroke mechanism 103 includes the rotary member 125, a housing member 126, and a cylindrical member (fixing member) 127.

The housing member 126 houses the holding member 12 therein. More specifically, the housing member 126 includes a cylindrical portion 135, and a ring-shaped flange portion 136 provided on the other side (the upper side in FIG. 4) of the cylindrical portion 135 in the axial direction. The cylindrical portion 135 and the flange portion 136 are integrally formed.

The cylindrical portion 135 is formed in a cylindrical shape as a result of a housing hole 138, which houses the holding member 12, being formed so as to penetrate through a central section of the cylindrical portion 135. Because the housing hole 138 has a complementary shape with the holding member 12, the housing hole 138 has a tapered shape that tapers toward the one side in the axial direction. Because the holding member 12, which is housed in the housing hole 138 of the housing member 126, and the housing hole 138 each have the tapered shape, the movement of the holding member 12 toward the one side (the lower side in FIG. 4) in the axial direction is restricted, even when a load is applied relatively to the one side.

The flange portion 136 is provided so as to protrude toward the outer side in the radial direction with respect to the cylindrical portion 135, while being formed in a ring-shape. The cylindrical member 127 is connected to a surface of the flange portion 136 on the one side (the lower side in FIG. 4) in the axial direction.

An inner left-hand thread groove 141 is formed on the inner circumferential surface of the cylindrical member 127. The other side (the upper side in FIG. 4) of the cylindrical member 127 in the axial direction is connected to the flange portion 136 of the housing member 126.

The rotary member 125 is provided on the outer side of the cylindrical portion 135 of the housing member 126, while being formed in a cylindrical shape. An outer right-hand thread groove 145, which engages with the inner right-hand thread groove 115 of the swaging member 101, and an outer left-hand thread groove 146, which engages with the inner left-hand thread groove 141 of the cylindrical member 127, are formed on the outer circumferential surface of the rotary member 125. More specifically, the rotary member 125 includes a right-hand thread side cylindrical portion 151, which has the outer right-hand thread groove 145 formed on the outer circumferential surface thereof, a left-hand thread side cylindrical portion 152, which has the outer left-hand thread groove 146 formed on the outer circumferential surface thereof, and a protrusion portion 153 provided between the right-hand thread side cylindrical portion 151 and the left-hand thread side cylindrical portion 152. The right-hand thread side cylindrical portion 151, the left-hand thread side cylindrical portion 152, and the protrusion portion 153 are integrally formed.

The right-hand thread side cylindrical portion 151 is provided on the one side of the rotary member 125 in the axial direction, while being provided between the cylindrical portion 117 of the swaging member 101 and the cylindrical portion 135 of the housing member 126. This right-hand thread side cylindrical portion 151 is provided so as to have a predetermined gap with respect to the housing member 126 provided on the inner side thereof. The right-hand thread side cylindrical portion 151 is in a non-contact state with the housing member 126. At the same time, the right-hand thread side cylindrical portion 151 is screwed with the swaging member 101 on the outer side thereof.

The left-hand thread side cylindrical portion 152 is provided on the other side of the rotary member 125 in the axial direction, while being provided between the cylindrical portion 127 and the cylindrical portion 135 of the housing member 126. This left-hand thread side cylindrical portion 152 is provided so as to have a predetermined gap with respect to the housing member 126 on the inner side thereof. The left-hand thread side cylindrical portion 152 is in a non-contact state with the housing member 126. At the same time, the left-hand thread side cylindrical portion 152 is screwed with the cylindrical member 127 on the outer side thereof.

The protrusion portion 153 is provided in a central section of the rotary member 125 in the axial direction, while being formed in a ring-shape and protruding toward the outer side of the rotary member 125 in the radial direction. This protrusion portion 153 is provided so as to have a predetermined gap with respect to the housing member 126 on the inner side thereof. The protrusion portion 153 is in a non-contact state with the housing member 126. Further, a surface of the protrusion portion 153 on the one side (the lower side in FIG. 4) in the axial direction is formed as a surface that comes into contact with the swaging member 101, and a surface of the protrusion portion 153 on the other side (the upper side in FIG. 4) in the axial direction is formed as a surface that comes into contact with the cylindrical member 127. Therefore, as a result of the cylindrical member 127 and the rotary member 125 coming into contact with each other and the rotary member 125 and the swaging member 101 coming into contact with each other, the movement of the rotary member 125 in the axial direction is restricted, and the swaging tool 100 obtains the most contracted state.

Next, a fastening operation of the swaging tool 100 will be described in which the lock bolt 5 is fastened by using the above-described swaging tool 100. The fastening pin 7 is inserted into the fastening hole 4 of the pair of plate members 3*a* and 3*b*, and the collar 8 is fitted to the pintail 7*c* side of the fastening pin 7. At this time, the swaging tool 100 is in the most contracted state, as illustrated in the left-side part of FIG. 4. The swaging tool 100 in this state is fitted to the pintail 7*c* of the fastening pin 7. More specifically, the pintail 7*c* side of the fastening pin 7 is inserted through the swaging die 119 of the swaging tool 100, and further, the pintail 7*c* is held by the holding member 12 as a result of the pintail 7*c* being fitted into the holding hole 21 of the holding member 12 of the swaging tool 100.

Subsequently, in a state in which the pintail 7*c* is held in the swaging tool 100, the rotary member 125 is rotated. When the rotary member 125 is rotated, the swaging tool 100 performs an expansion that causes a distance between the swaging member 101 and the holding member 12 in the axial direction to increase. At this time, because the swaging tool 100 is holding the pintail 7*c* by the holding member 12, when the expansion is performed, the swaging member 101 moves toward the plate member 3*b*. More specifically, when the rotary member 125 is rotated, the swaging member 101 moves in the axial direction toward the plate member 3*b* with respect to the right-hand thread side cylindrical portion 151 of the rotary member 125. Further, the left-hand thread side cylindrical portion 152 of the rotary member 125 moves in the axial direction toward the plate member 3*b* with respect to the cylindrical member 127. At this time, because the rotating rotary member 125 is screwed with the swaging member 101 by a right-hand thread and is screwed with the cylindrical member 127 by a left-hand thread, the swaging member 101 and the cylindrical member 127 do not rotate, even when the rotary member 125 is rotated. Accordingly, the housing member 126 connected to the cylindrical member 127 does not rotate, and the holding member 12 housed in the housing member 126 does not rotate, either. When the swaging member 101 moves toward the plate member 3*b*, the swaging member 101 comes into contact with the collar 8 fitted to the pintail 7*c* side, thereby pushing the collar 8 toward the plate member 3*b*. Then, the collar 8, which is pushed toward the plate member 3*b*, comes into contact with the plate member 3*b*. As a result, the collar 8, which is in contact with the plate member 3*b*, is positioned at the pin main body 7*b* of the fastening pin 7.

After this, in the swaging tool 100, the rotary member 125 is further rotated in a state in which the collar 8 is in contact with the plate member 3*b*. When the rotary member 125 is rotated, as a result of the swaging tool 100 further performing the expansion, the collar 8 is press-fitted into the swaging die 119 of the swaging member 101. The collar 8 is swaged to the pin main body 7*b* of the fastening pin 7 as a result of being press-fitted into the swaging die 119.

Then, in the swaging tool 100, the rotary member 125 is further rotated in a state in which the collar 8 is swaged to the pin main body 7*b*. When the rotary member 125 is rotated, as a result of the swaging tool 100 further performing the expansion, each of the pin main body 7*b* and the pintail 7*c* is pulled in the direction of separating away from each other, and consequently, the predetermined tensile load is applied to the break-off portion 7*d* provided between the pin main body 7*b* and the pintail 7*c*. The swaging tool 100 causes the pintail 7*c* of the fastening pin 7 to break off by applying the predetermined tensile load to the break-off portion 7*d*. When the pintail 7*c* breaks off, the swaging tool 100 is disconnected from the fastened lock bolt 5 in a state in which the broken-off pintail 7*c* is held by the holding member 12.

Note that the swaging tool 100, which has been disconnected from the lock bolt 5, performs a contraction, which causes the distance between the swaging member 101 and the holding member 12 in the axial direction to decrease, by rotating the rotary member 125 in the opposite direction. By performing the contraction, the swaging tool 100 obtains the most contracted state as a result of the swaging member 101 and the cylindrical member coming into contact with the protrusion portion 153 of the rotary member 125. Then, by removing the broken-off pintail 7*c* held by the holding member 12, the swaging tool 100 returns to the state illustrated in the left-side part of FIG. 4.

As described above, according to the configuration of the third embodiment, the rotation of the rotary member 125 makes it possible to expand and contract the space between the swaging member 101 and the holding member 12 without causing the swaging member 101 and the cylindrical member 127 to rotate, both of which are screwed with the rotary member 125. Further, because it is possible to offset the rotation of the rotary member 125 by forming the right-hand thread on the one side of the rotary member 125 in the axial direction and the left-hand thread on the other side of the rotary member 125 in the axial direction, it is possible to restrict the rotation of the holding member 12 housed in the housing member 126 and the rotation of the swaging member 101.

Fourth Embodiment

Figure 5:
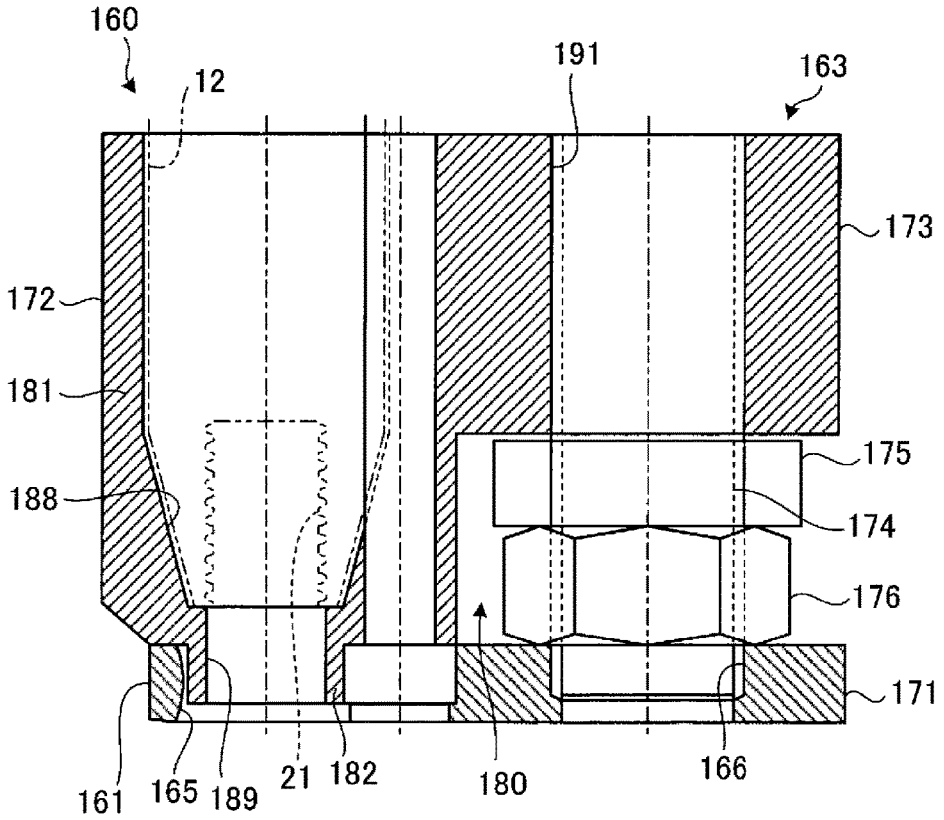
FIG. 5 is a cross-sectional view of a swaging tool according to a fourth embodiment.

Next, a swaging tool 160 according to a fourth embodiment will be described with reference to FIG. 5. FIG. 5 is a cross-sectional view of the swaging tool according to the fourth embodiment. Note that in the fourth embodiment also, in order to avoid redundant descriptions, descriptions will be given only for structural elements different from those of the first to third embodiments, and the same reference numerals will be assigned to structural elements having the same configuration as those of the first to third embodiments. In the swaging tools 1, 50, and 100 according to the first to third embodiments, the stroke mechanisms 13, 53, and 103 are respectively provided between the swaging members 11, 51, and 101 and the holding member 12. However, in the swaging tool 160 according to the fourth embodiment, a stroke mechanism 163 is provided in a different position from those of the first to third embodiments. The swaging tool 160 according to the fourth embodiment will be described below. Note that the swaging tool 160 in a contracted state is illustrated in FIG. 5.

As illustrated in FIG. 5, the swaging tool 160 according to the fourth embodiment includes a swaging member 161, the holding member 12, and the stroke mechanism 163. Note that because the holding member 12 has the same configuration as in the first embodiment, a description thereof is omitted here.

The swaging member 161 is formed in a plate-shape, and a swaging die 165 is formed so as to penetrate through the swaging member 161. The swaging die 165 sewages the collar 8 as a result of the collar 8, which is fitted to the fastening pin 7, being press-fitted into the swaging die 165. Further, a second extending portion 171 is integrally provided in the swaging member 161. The second extending portion 171 is provided so as to extend from the swaging member 161. A fastening hole 166 is formed in the second extending portion 171. This second extending portion 171 constitutes part of the stroke mechanism 163 which will be described below. At this time, a penetrating direction of the swaging die 165 and a penetrating direction of the fastening hole 166 are the same direction, and the swaging die 165 and the fastening hole 166 are formed side by side with each other. An end portion of a guide screw rod (guide member) 174, which will be described below, is fastened to the fastening hole 166. Note that even though the second extending portion 171 is integrally formed with the swaging member 161 in the fourth embodiment, the present invention is not limited to this embodiment, and the second extending portion 171 and the swaging member 161 may be formed separately.

The stroke mechanism 163 is provided adjacent to the swaging member 161 and the holding member 12. The rotation of the stroke mechanism 163 expands and contracts a space between the swaging member 161 and the holding member 12 in the axial direction. Further, the stroke mechanism 163 is configured so as to be able to restrict the rotation of the swaging member 161 and the holding member 12. More specifically, the stroke mechanism 163 includes the above-described second extending portion 171, a housing member 172, a first extending portion 173, the guide screw rod 174, a rotary member 175, and a restricting member 176.

The housing member 172 houses the holding member 12 therein. More specifically, the housing member 172 includes a cylindrical portion 181, and a ring-shaped protruding portion 182 that is provided on the one side (the lower side in FIG. 5) of the cylindrical portion 181 in the axial direction. The cylindrical portion 181 and the protruding portion 182 are integrally formed.

The cylindrical portion 181 is formed in a cylindrical shape as a result of a housing hole 188, which houses the holding member 12, being formed so as to penetrate through a central section of the cylindrical portion 181. Because the housing hole 188 has a complementary shape with the holding member 12, the housing hole 188 has a tapered shape that tapers toward the one side in the axial direction. Because the holding member 12, which is housed in the housing hole 188 of the housing member 172, and the housing hole 188 each have the tapered shape, the movement of the holding member 12 toward the one side (the lower side in FIG. 5) in the axial direction is restricted, even when a load is applied relatively to the one side.

The protruding portion 182 is provided so as to protrude from the one side of the cylindrical portion 181 in the axial direction toward the swaging die 165 of the swaging member 161. The protruding portion 182 is formed in a ring-shape as a result of an insertion hole 189, through which the pintail 7*c* of the fastening pin 7 is inserted, being formed in a central section of the protruding portion 182. The insertion hole 189 is communicated with the housing hole 188 on the other side in the axial direction and communicated with the swaging die 165 on the one side in the axial direction. The outer diameter of the protruding portion 182 is smaller than the inner diameter of the swaging die 165. Meanwhile, the inner diameter of the protruding portion 182 (namely, the diameter of the insertion hole 189) is larger than the pintail 7*c* of the fastening pin 7. This protruding portion 182 can be brought into contact with the collar 8, when a space between the holding member 12 and the swaging member 161 is contracted.

Further, the first extending portion 173 is integrally provided in the housing member 172. The first extending portion 173 is provided so as to extend from the other side (the upper side in FIG. 5) of the cylindrical portion 181 in the axial direction toward the outer side of the cylindrical portion 181 in the radial direction. Further, the first extending portion 173 is provided so as to face the second extending portion 171 in the axial direction. A guide hole 191 is formed so as to penetrate through the first extending portion 173 in the same direction as the axial direction of the cylindrical portion 182. At this time, the guide hole 191 is formed so as to face the fastening hole 166 of the swaging member 161. The guide screw rod 174 is inserted through the guide hole 191. A space (gap) 180, which can house the rotary member 175 and the restricting member 176 (both described below), is formed between the first extending portion 173 and the second extending portion 171.

The guide screw rod 174, which is a rod-shaped member, has a thread groove formed on the outer circumferential surface thereof. The guide screw rod 174 is provided extending from the first extending portion 173 to the second extending portion 171 through the space 180. More specifically, the guide screw rod 174 is fixed as a result of being inserted through the guide hole 191 of the first extending portion 173 and having its one side (the lower side in FIG. 5) in the axial direction fastened to the fastening hole 166.

The restricting member 176 is attached to the guide screw rod 174, which is positioned in the space 180 provided between the first extending portion 173 and the second extending portion 171. The restricting member 176 is constituted by a nut, for example, and suppresses loosening of the guide screw rod 174 with respect to the fastening hole 166, as a result of being screwed with the one side (the lower side in FIG. 5) of the guide screw rod 174 in the axial direction.

The rotary member 175 is attached to the guide screw rod 174, which is positioned in the space 180 provided between the first extending portion 173 and the second extending portion 171. The rotary member 175 is constituted by a nut, for example, in the same manner as the restricting member 176, and is screwed with the other side (the lower side in FIG. 5) of the guide screw rod 174 in the axial direction, namely, screwed with the guide screw rod 174 positioned between the restricting member 176 and the first extending portion 173. This rotary member 175 is rotated to come into contact with the first extending portion 173 and then further rotated to cause the first extending portion 173 to move relatively away from the second extending portion 171.

Next, a fastening operation of the swaging tool 160 will be described in which the lock bolt 5 is fastened by using the above-described swaging tool 160. The fastening pin 7 is inserted into the fastening hole 4 of the pair of plate members 3*a* and 3*b*, and the collar 8 is fitted to the pintail 7*c* side of the fastening pin 7. At this time, the swaging tool 160 is in the most contracted state, as illustrated in FIG. 5. The swaging tool 160 in this state is fitted to the pintail 7*c* of the fastening pin 7. More specifically, the pintail 7*c* side of the fastening pin 7 is inserted through the swaging die 165 of the swaging tool 160 and the insertion hole 189 of the housing member 172, and the pintail 7*c* is held by the holding member 12 as a result of the pintail 7*c* being fitted into the holding hole 21 of the holding member 12 of the swaging tool 160.

Subsequently, in a state in which the pintail 7*c* is held in the swaging tool 160, the rotary member 175 is rotated. When the rotary member 175 is rotated, the swaging tool 160 performs an expansion that causes a distance between the swaging member 161 and the holding member 12 in the axial direction to increase. At this time, because the swaging tool 160 is holding the pintail 7*c* by the holding member 12, when the expansion is performed, the swaging member 161 moves toward the plate member 3*b*. More specifically, when the rotary member 175 is rotated, the rotary member 175 moves toward the first extending portion 173 along the guide screw rod 174 and then comes into contact with the first extending portion 173. After this, in a state of being in contact with the first extending portion 173, the rotary member 175 is further rotated to cause the guide screw rod 174 to move so as to expand the space 180 provided between the first extending portion 173 and the second extending portion 171 in the axial direction. Accordingly, the rotating rotary member 175 causes the second extending portion 171 fixed to the guide screw rod 174 to move away from the first extending portion 173. As a result, the swaging member 161 moves in the axial direction toward the plate member 3*b*. When the swaging member 161 moves toward the plate member 3*b*, the swaging member 161 comes into contact with the collar 8 fitted to the pintail 7*c* side, thereby pushing the collar 8 toward the plate member 3*b*. Then, the collar 8, which is pushed toward the plate member 3*b*, comes into contact with the plate member 3*b*. As a result, the collar 8, which is in contact with the plate member 3*b*, is positioned at the pin main body 7*b* of the fastening pin 7.

After this, in the swaging tool 160, the rotary member 175 is further rotated in a state in which the collar 8 is in contact with the plate member 3*b*. When the rotary member 175 is rotated, as a result of the swaging tool 160 further performing the expansion, the collar 8 is press-fitted into the swaging die 165 of the swaging member 161. The collar 8 is swaged to the pin main body 7*b* of the fastening pin 7 as a result of being press-fitted into the swaging die 165.

Then, in the swaging tool 160, the rotary member 175 is further rotated in a state in which the collar 8 is swaged to the pin main body 7*b*. When the rotary member 175 is rotated, as a result of the swaging tool 160 further performing the expansion, each of the pin main body 7*b* and the pintail 7*c* is pulled in the direction of separating away from each other, and consequently, the predetermined tensile load is applied to the break-off portion 7*d* provided between the pin main body 7*b* and the pintail 7*c*. The swaging tool 160 causes the pintail 7*c* of the fastening pin 7 to break off by applying the predetermined tensile load to the break-off portion 7*d*. When the pintail 7*c* breaks off, the swaging tool 160 is disconnected from the fastened lock bolt 5 in a state in which the broken-off pintail 7*c* is held by the holding member 12.

Note that the swaging tool 160, which has been disconnected from the lock bolt 5, performs a contraction, which causes the distance between the swaging member 161 and the holding member 12 in the axial direction to decrease, by rotating the rotary member 175 in the opposite direction. At this time, because the collar 8 is press-fitted into (fitted with) the swaging die 165 of the swaging member 161, the housing member 172 moves toward the swaging member 161 when the rotary member 175 is rotated in the opposite direction. When the housing member 172 approaches the swaging member 161, the protruding portion 182 of the housing member 172 approaches the swaging die 165 of the swaging member 161 and then comes into contact with the swaged collar 8. When the housing member 172 moves toward the swaging member 161 in a state in which the collar 8 is in contact with the protruding portion 182, because the position of the housing member 172 is restricted, the swaging member 161 moves in a direction in which the collar 8 is pulled out. Then, as a result of the swaging tool 160 performing the contraction, the collar 8 is removed from the swaging member 161. After this, the broken-off pintail 7*c*, which is held by the holding member 12, is removed from the swaging tool 160.

As described above, according to the configuration of the forth embodiment, the rotation of the rotary member 175 makes it possible to expand and contract the space between the swaging member 161 and the holding member 12 without causing the swaging member 161 and the housing member 172 to rotate, both of which are screwed with the rotary member 175. At this time, because the rotary member 175 rotates with respect to the guide screw rod 174, the rotation of the rotary member 175 is not transmitted to the housing member 172 and the swaging member 161, and it is thus possible to restrict the rotation of the holding member 12 housed in the housing member 172 and the rotation of the swaging member 161.

Further, according to the configuration of the fourth embodiment, as a result of providing the protruding portion 182 in the housing member 172, it is possible to easily pull out the swaging member 161, which has been fitted with the collar 8, by causing the housing member 172 to move toward the swaging member 161 in a state in which the collar 8 is in contact with the protruding portion 182.

Fifth Embodiment

Figure 6:
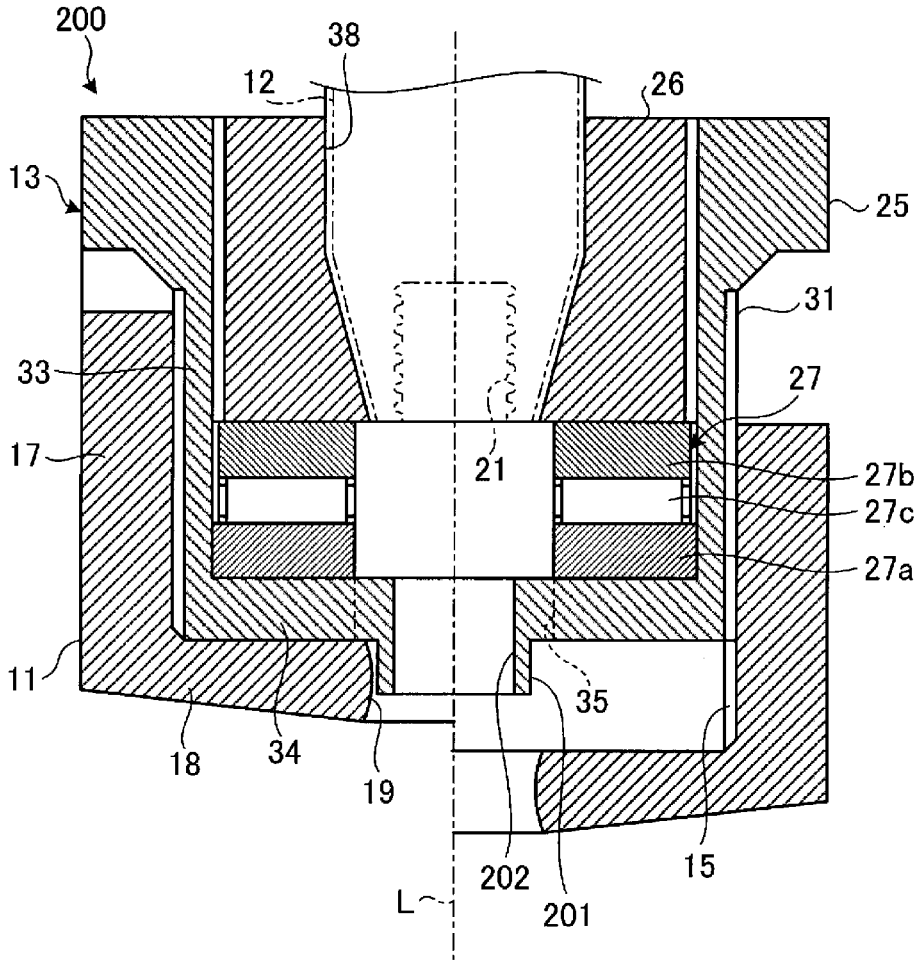
FIG. 6 is a cross-sectional view of a swaging tool according to a fifth embodiment.

Next, a swaging tool 200 according to a fifth embodiment will be described with reference to FIG. 6. FIG. 6 is a cross-sectional view of the swaging tool according to the fifth embodiment. Note that in the fifth embodiment also, in order to avoid redundant descriptions, descriptions will be given only for structural elements different from those of the first to fourth embodiments, and the same reference numerals will be assigned to structural elements having the same configuration as those of the first to fourth embodiments. The swaging tool 200 according to the fifth embodiment is configured by adding the protruding portion 182 of the fourth embodiment to the swaging tool 1 of the first embodiment. The swaging tool 200 according to the fifth embodiment will be described below. Note that in FIG. 6, in the same manner as in FIG. 2, part on the left side of the axial line L illustrates a contracted state of the swaging tool 200, and part on the right side of the axial line L illustrates an expanded state of the swaging tool 200.

As illustrated in FIG. 6, the swaging tool 200 according to the fifth embodiment is configured by adding a protruding portion 201, which is provided on the inner circumferential surface of the insertion hole 35 of the rotary member 25, to the configuration of the swaging tool 1 according to the first embodiment. More specifically, the protruding portion 201 is provided so as to protrude from the bottom portion 34 toward the swaging die 19 of the swaging member 11. The protruding portion 201 is formed in a ring-shape as a result of an insertion hole 202, through which the pintail 7*c* of the fastening pin 7 is inserted, being formed in a central section of the protruding portion 201. The diameter of the insertion hole 202 is smaller than that of the insertion hole 35. The insertion hole 202 is communicated with the housing hole 21, via the bearing 27, on the other side in the axial direction and communicated with the swaging die 19 on the one side in the axial direction. The outer diameter of the protruding portion 201 is smaller than the inner diameter of the swaging die 19. Meanwhile, the inner diameter of the protruding portion 201 (namely, the diameter of the insertion hole 202) is larger than the pintail 7*c* of the fastening pin 7. This protruding portion 201 can be brought into contact with the collar 8, when a space between the holding member 12 and the swaging member 11 is contracted.

The swaging tool 200, which is configured in the above-described manner, causes the rotary member 25 to approach the swaging member 11 by rotating the rotary member 25 in the opposite direction in a state in which the collar 8 is press-fitted into the swaging die 19 of the swaging member 11. As a result, the protruding portion 201 of the rotary member 25 comes into contact with the swaged collar 8. Then, when the rotary member 25 moves toward the swaging member 11 in a state in which the protruding portion 201 is in contact with the collar 8, because the position of the rotary member 25 is restricted, the swaging member 11 moves in the direction in which the collar 8 is pulled out. As a result of the swaging tool 200 performing the contraction, the collar 8 is removed from the swaging member 11.

As described above, according to the configuration of the fifth embodiment, as a result of providing the protruding portion 201 in the rotary member 25, it is possible to easily pull out the swaging member 11, which has been fitted with the collar 8, by causing the rotary member 25 to move toward the swaging member 11 in a state in which the protruding portion 201 is in contact with the collar 8.

Note that the protruding portion 182 of the fourth embodiment or the protruding portion 201 of the fifth embodiment may be applied to the second embodiment or the third embodiment, and further may also be applied to a sixth embodiment which will be described below. When a protruding portion is applied to the second embodiment, the protruding portion is preferably provided in the housing member 66 in the same manner as in the fourth embodiment. When a protruding portion is applied to the third embodiment, the protruding portion is preferably provided in the housing member 126 in the same manner as in the fourth embodiment.

Sixth Embodiment

Figure 7:
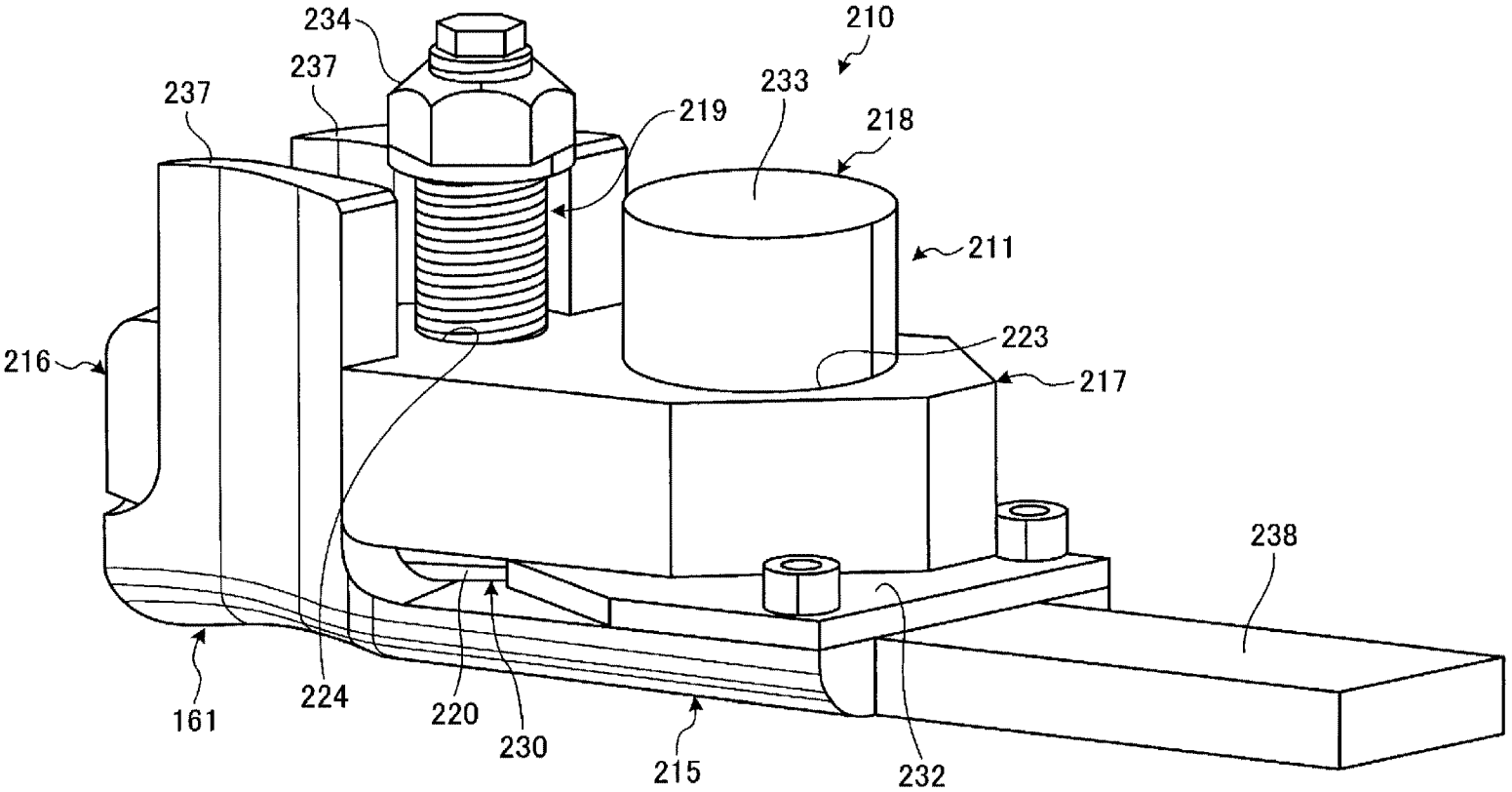
FIG. 7 is an external perspective view of a swaging tool according to a sixth embodiment.

Next, a swaging tool 210 according to the sixth embodiment will be described with reference to FIG. 7. FIG. 7 is an external perspective view of the swaging tool according to the sixth embodiment. Note that in the sixth embodiment also, in order to avoid redundant descriptions, descriptions will be given only for structural elements different from those of the first to fifth embodiments, and the same reference numerals will be assigned to structural elements having the same configuration as those of the first to fifth embodiments.

In the swaging tool 160 according to the fourth embodiment, the stroke mechanism 163 is provided adjacent to the swaging member 161 and the holding member 12, and the expansion is performed while guiding the first extending portion 173 and the second extending portion 171 to move relatively away from each other using the guide screw rod 174 and the rotary member 175 of the stroke mechanism 163.

In contrast, in the swaging tool 210 of the sixth embodiment, a stroke mechanism 211 is provided adjacent to the swaging member 161 and the holding member 12, and the stroke mechanism 211 is configured so that a guiding part, which is formed by the first extending portion 173 and the second extending portion 171, and a driving part, which is related to the expansion, are offset with respect to each other. Next, the swaging tool 210 according to the sixth embodiment will be described with reference to FIG. 7.

As illustrated in FIG. 7, the swaging tool 210 according to the sixth embodiment includes the swaging member 161, the holding member 12, and the stroke mechanism 211. Note that because the holding member 12 and the swaging member 161 each have the same configuration as in the fourth embodiment, descriptions thereof are omitted here.

The stroke mechanism 211 is provided adjacent to the swaging member 161 and the holding member 12. The rotation of the stroke mechanism 211 expands and contracts the space between the swaging member 161 and the holding member 12 in the axial direction. Further, the stroke mechanism 211 is configured so as to be able to restrict the rotation of the swaging member 161 and the holding member 12. More specifically, the stroke mechanism 211 includes a second extending portion 215, a housing member 216, a first extending portion 217, a guide member 218, a screw shaft (drive shaft) 219, and a rotary member 220.

The second extending portion 215 is provided so as to extend outwardly from the swaging member 161 and is integrally formed with the swaging member 161. The guide member 218 and the screw shaft 219 are attached to this second extending portion 215. The screw shaft 219 is attached to the second extending portion 215, adjacent to the swaging member 161, and the guide member 218 is attached to the second extending portion 215, remote from the swaging member 161 while sandwiching the screw shaft 219 between the guide member 218 and the swaging member 161. Thus, a fastening hole (not illustrated), to which the screw shaft 219 is attached, is formed in the second extending portion 215, and one end portion of the screw shaft 219 in the axial direction is fastened to this fastening hole. Note that even though the second extending portion 215 is integrally formed with the swaging member 161 in the sixth embodiment, the present invention is not limited to this embodiment, and the second extending portion 215 and the swaging member 161 may be formed separately.

Because the housing member 216 is the same as the housing member 172 of the fourth embodiment, a description thereof is omitted here. Then, the first extending portion 217 is integrally provided in the housing member 216.

The first extending portion 217 is provided so as to extend outwardly from the housing member 216. Further, the first extending portion 217 is provided so as to face the second extending portion 215. A guide hole 223, through which the guide member 218 is inserted, and a through hole 224, through which the screw shaft 219 is inserted, are formed in the first extending portion 217. The guide hole 223 and the through hole 224 are formed so as to penetrate through the first extending portion 217, while having the axial direction thereof aligned with the direction in which the first extending portion 217 and the second extending portion 215 face each other. Then, the through hole 224 is formed in the first extending portion 217, adjacent to the housing member 216, and the guide hole 223 is formed in the first extending portion 217, remote from the housing member 216 while sandwiching the through hole 224 between the guide hole 223 and the housing member 216. Thus, the through hole 224 faces the fastening hole, which is formed in the first extending portion 217, and the screw shaft 219, which is fastened to the fastening hole, is inserted through the through hole 224. Further, the guide member 218, which is attached to the second extending portion, is inserted through the guide hole 223. A space (gap) 230, which can house the rotary member 220 (described below), is formed between the first extending portion 217 and the second extending portion 215.

The guide member 218 is integrally formed by an attachment plate 232, which is attached to the second extending portion 215, and a guide rod 233, which protrudes from the attachment plate 232 through the first extending portion 217. The attachment plate 232 is formed in a plate-shape and fixed to the second extending portion 215 by a screw. The guide rod 233 is formed in a cylindrical shape while having the axial direction thereof aligned with the direction in which the first extending portion 217 and the second extending portion 215 face each other. The guide rod 233 guides the movement of the first extending portion 217 in the axial direction by being inserted through the guide hole 223.

One end portion of the screw shaft 219 in the axial direction is fastened to the fastening hole of the second extending portion 215, and in the other end portion of the screw shaft 219 in the axial direction, a restricting member 234 is provided that restricts a position of the first extending portion 217, which moves in the axial direction. The restricting member 234 is constituted by a nut, for example.

The rotary member 220 is attached to the screw shaft 219, which is positioned in the space 230 provided between the first extending portion 217 and the second extending portion 215. The rotary member 220 is constituted by a nut, for example, and screwed with the screw shaft 219. This rotary member 220 is rotated to come into contact with the first extending portion 217 and then further rotated to cause the first extending portion 217 to move relatively away from the second extending portion 215.

Note that a pair of width restricting members 237 are integrally formed in the swaging member 161. A pair of width restricting members 237 restrict positions of the housing member 216 and the first extending portion 217, which are integrally formed with each other. The pair of width restricting members 237 are provided so as to extend from the swaging member 161 toward the housing member 216 in the same direction as the axial direction of the screw shaft 219. Then, the pair of width restricting members 237 are disposed so as to sandwich the housing member 216 therebetween. Further, a gripping portion 238, which can be gripped by an operator, is integrally provided in an end portion of the second extending portion 215 on the opposite side to the swaging member 161.

Next, a fastening operation of the swaging tool 210, in which the lock bolt 5 is fastened by using the above-described swaging tool 210, will be described. The fastening pin 7 is inserted into the fastening hole 4 of the pair of plate members 3*a* and 3*b*, and the collar 8 is fitted to the pintail 7*c* side of the fastening pin 7. At this time, the swaging tool 210 is in the most contracted state, in which the space 230 provided between the first extending portion 217 and the second extending portion 215 is narrowest. The swaging tool 210 in this state is fitted to the pintail 7*c* of the fastening pin 7. More specifically, the pintail 7*c* side of the fastening pin 7 is inserted through the swaging die 165, which is formed in the swaging member 161 of the swaging tool 210, and the insertion hole 189, which is formed in the housing member 172. Further, the pintail 7*c* is held by the holding member 12 as a result of the pintail 7*c* being fitted into the holding hole 21 formed in the holding member 12 of the swaging tool 210.

Subsequently, in a state in which the pintail 7*c* is held in the swaging tool 210, the rotary member 220 is rotated by a power source (not illustrated). When the rotary member 220 is rotated, the swaging tool 210 expands a gap between the first extending portion 217 and the second extending portion 215 in the axial direction of the screw shaft 219. Accordingly, the swaging tool 210 performs an expansion that causes the distance between the swaging member 161 and the holding member 12 in the axial direction to increase. When the expansion is performed, the pintail 7*c* is held by the holding member 12 in the swaging tool 210. As a result, the swaging member 161 moves toward the plate member 3*b*.

More specifically, when the rotary member 220 is rotated, the rotary member 220 moves toward the first extending portion 217 along the screw shaft 219 and then comes into contact with the first extending portion 217. After this, in a state of being in contact with the first extending portion 217, the rotary member 220 is further rotated to move along the screw shaft 219 so as to expand the space 230 provided between the first extending portion 215 and the second extending portion 217 in the axial direction. At this time, the guide hole 223, which is formed in the second extending portion 215, guides the relative movements of the first extending portion 217 and the second extending portion 215 by moving along the guide member 218, which is attached to the first extending portion 217. As a result, the swaging member 161 moves in the axial direction toward the plate member 3*b*, while being guided by the guide member 218.

When the swaging member 161 moves toward the plate member 3*b*, the swaging member 161 comes into contact with the collar 8 fitted to the pintail 7*c* side, thereby pushing the collar 8 toward the plate member 3*b*. Then, the collar 8, which is pushed toward the plate member 3*b*, comes into contact with the plate member 3*b*. As a result, the collar 8, which is in contact with the plate member 3*b*, is positioned at the pin main body 7*b* of the fastening pin 7. Note that, because the subsequent fastening operation is the same as in the fourth embodiment, a description thereof is omitted here.

As described above, according to the configuration of the sixth embodiment, by disposing the guide member 218 and the screw shaft 219 adjacent to each other, it is possible to provide the guiding part and the driving part so that the guiding part and the driving part are offset with respect to each other. Accordingly, even when the rigidity of the guide member 218 is increased by making the guide member 218 larger in order to apply a large tensile load to the lock bolt 5, it is possible to suppress an increase in the dimension of the swaging tool 210 in the axial direction. As a result, it is possible to fasten the lock bolt 5 in a stable manner by using the compact swaging tool 210.

The invention claimed is:

1. A swaging tool for fastening a portion to be fastened, the swaging tool being configured to move a collar fitted to a pintail side of a fastening pin toward a pinhead side so as to bring the collar into contact with the portion to be fastened, the pinhead of the fastening pin being positioned on one side of the portion to be fastened through which the fastening pin is inserted and the pintail of the fastening pin being positioned on another side of the portion to be fastened, to swage the collar to the fastening pin with the collar being in contact with the portion to be fastened, and to apply a tensile load to the pintail to break off and remove the pintail, the swaging tool comprising:

a holding member configured to hold the pintail of the fastening pin;

a swaging member having a swaging die formed therein, the swaging die being configured to come into contact with and swage the collar; and a stroke mechanism configured to expand and contract a space between the swaging member and the holding member, the stroke mechanism including a rotatable rotary member and being configured to convert a rotation of the rotary member to an expansion and contraction of the space between the holding member and the swaging member and to restrict a rotation of the swaging member and a rotation of the holding member, wherein the stroke mechanism is provided between the holding member and the swaging member, the stroke mechanism including:

a housing member configured to house the holding member therein;

the rotary member provided between the housing member and the swaging member, the rotary member being configured to be screwed with the swaging member; and a low friction mechanism provided between the rotary member and the housing member, the low friction mechanism being capable of absorbing the rotation of the rotary member, and the rotation of the rotary member causes the swaging member to perform the expansion and contraction.

2. A swaging tool for fastening a portion to be fastened, the swaging tool being configured to move a collar fitted to a pintail side of a fastening pin toward a pinhead side so as to bring the collar into contact with the portion to be fastened, the pinhead of the fastening pin being positioned on one side of the portion to be fastened through which the fastening pin is inserted and the pintail of the fastening pin being positioned on another side of the portion to be fastened, to swage the collar to the fastening pin with the collar being in contact with the portion to be fastened, and to apply a tensile load to the pintail to break off and remove the pintail, the swaging tool comprising:

a holding member configured to hold the pintail of the fastening pin;

a swaging member having a swaging die formed therein, the swaging die being configured to come into contact with and swage the collar; and a stroke mechanism configured to expand and contract a space between the swaging member and the holding member, the stroke mechanism including a rotatable rotary member and being configured to convert a rotation of the rotary member to an expansion and contraction of the space between the holding member and the swaging member and to restrict a rotation of the swaging member and a rotation of the holding member, wherein the stroke mechanism is provided between the holding member and the swaging member, the stroke mechanism including:

a housing member configured to house the holding member therein;

the rotary member configured to be screwed with the housing member; and a movable member provided between the rotary member and the swaging member, the movable member being configured to come into contact with the rotary member and to be connected to the swaging member, and to perform the expansion and contraction together with the rotary member through the rotation of the rotary member, and the movable member is locked with respect to the housing member so as to be able to perform the expansion and contraction while the rotation of the movable member is restricted with respect to the housing member.

3. The swaging member according to claim 2, wherein the movable member includes a locking claw configured to restrict the rotation of the movable member with respect to the housing member and to allow the movable member to perform the expansion and contraction with respect to the housing member, and a locking groove configured to house the locking claw is formed in the housing member.

4. A swaging tool for fastening a portion to be fastened, the swaging tool being configured to move a collar fitted to a pintail side of a fastening pin toward a pinhead side so as to bring the collar into contact with the portion to be fastened, the pinhead of the fastening pin being positioned on one side of the portion to be fastened through which the fastening pin is inserted and the pintail of the fastening pin being positioned on another side of the portion to be fastened, to swage the collar to the fastening pin with the collar being in contact with the portion to be fastened, and to apply a tensile load to the pintail to break off and remove the pintail, the swaging tool comprising:

a holding member configured to hold the pintail of the fastening pin;

a swaging member having a swaging die formed therein, the swaging die being configured to come into contact with and swage the collar; and a stroke mechanism configured to expand and contract a space between the swaging member and the holding member, the stroke mechanism including a rotatable rotary member and being configured to convert a rotation of the rotary member to an expansion and contraction of the space between the holding member and the swaging member and to restrict a rotation of the swaging member and a rotation of the holding member, wherein the stroke mechanism is provided between the holding member and the swaging member, the stroke mechanism including:

a housing member configured to house the holding member therein;

a fixing member configured to be fixed to the housing member; and the rotary member configured to be screwed with the fixing member as well as with the swaging member, the rotary member and the swaging member are screwed with each other by one of a right-hand thread and a left-hand thread, and the rotary member and the fixing member are screwed with each other by the other one of the right-hand thread and the left-hand thread.

* * * * *